US005267921A

United States Patent [19]

Roehlk

[11] Patent Number: 5,267,921

[45] Date of Patent: Dec. 7, 1993

[54] BIASED SPRING EXERCISE APPARATUS

[76] Inventor: Ruth P. Roehlk, 25804 Texas Ct., Sun Lakes, Ariz. 85284

[21] Appl. No.: 899,604

[22] Filed: Jun. 16, 1992

[51] Int. Cl.[5] ..... A63B 21/045

[52] U.S. Cl. ..... 482/44; 482/126; 482/127

[58] Field of Search ..... 482/44, 45, 49, 121, 482/122, 126, 127

[56] References Cited

U.S. PATENT DOCUMENTS 4,651,985 3/1987 Salisbury ..... 482/122

4,805,899 2/1989 Roehlk ..... 482/127

5,046,727 9/1991 Wilkinson et al. ..... 482/127

*Primary Examiner*—Richard J. Apley

*Assistant Examiner*—Lynne A. Reichard

*Attorney, Agent, or Firm*—Tod R. Nissle

[57] ABSTRACT

A hand held exercise device includes a pair of handle units, a stem extending between the handle units, and, a pair of coiled springs which circumscribe the stem. The coiled springs are interposed between he handle units. The handle units are manually grasped and turned in opposite directions with respect to one another to tension the springs and provide variable resistance to such turning of the handle units.

6 Claims, 3 Drawing Sheets

10

40
24
25
46
42
29
44
31
28
30
26
27
11
18
14
15
17
16
14
12
20
23
22
20
21
13
19
41
33
35
32
45
47
43
34

BIASED SPRING EXERCISE APPARATUS

BACKGROUND OF THE INVENTION

1. Field of the Invention

This invention relates to exercise equipment.

More particularly, the invention relates to a hand held exercise device which is used to strengthen a person's wrists and arms and which includes a pair of handle units; a stem extending between the handle units; and, a pair of coil springs which circumscribe the stem and a centerline and which are interposed between and connected to the handle units, the handle units being manually grasped and turned in opposite directions with respect to one another about the centerline to tension the springs and provide variable resistance to such turning of the handle units.

In a further respect, the invention relates to a hand held exercise device of the type described which prevents the coil springs from becoming intertwined and binding when the handle units are turned about the centerline of the exercise device.

In still another respect, the invention relates to a hand held exercise device of the type described which biases the coil springs against a damping member to minimize the sound produced by the springs during use of the exercise device and which extends the useful life of the device.

2. Description of the Related Art

The exercise apparatus described in my U.S. Pat. No. 4,805,899 includes a pair of handle units each having a base 15 and handle 13, a stem 16 extending between the handle units, and a pair of intertwined springs 31 which are each connected at either end to a handle unit. When the handle units are rotated in opposite directions, the springs generate forces opposing rotation of the handle units. While this exercise apparatus is useful in exercise the wrists and arms, there are disadvantages associated with operation of the apparatus. First, when the springs are intertwined in the manner described in U.S. Pat. No. 4,805,899, the springs tend to frictionally engage one another and, eventually, to lock or bind when the handle units are twisted to tension the springs. Such binding restricts the range of motion through which the handle units can be rotated. Second, coils of the springs 31 tend to be laterally displaced against and to slap or otherwise contact the stem 16. This generates noise during operation of the exercise apparatus and also promotes wear of the springs and of the stem 16.

Accordingly, it would be highly desirable to provide an improved exercise apparatus which includes a pair of handle units, a stem extending between the handle units, and a pair of springs connected to the handle units; and, which would, during operation of the exercise apparatus, minimize binding of the springs, contact of the springs with the stem, and the noise generated when the springs contact the stem.

Therefore, it is a principal object of the invention to provide improved exercise apparatus.

Another object of the invention is to provide improved exercise apparatus of the type including a pair of handle units, a stem extending between the handle units, and a pair of coil springs which are each connected to the handle units to generate resistance when the handle units are simultaneously rotated in opposing directions.

A further object of the invention is to provide improved exercise apparatus of the type described which minimizes binding of the springs against one another during use of the apparatus.

Still another object of the invention is to provide improved exercise apparatus of the type described which minimizes the contact between the coil spring and the stem extending between the coil units.

Yet a further object of the invention is to provide improved exercise apparatus of the type described which biases the coil springs against a damper member to maintain spacing between the springs and absorb sound produced during operation of the exercise apparatus.

BRIEF DESCRIPTION OF THE DRAWINGS

These and other, further and more specific objects and advantages of the invention will be apparent to those skilled in the art from the following detailed description thereof, taken in conjunction with the drawings, in which.

SUMMARY OF THE INVENTION

Figure 1:
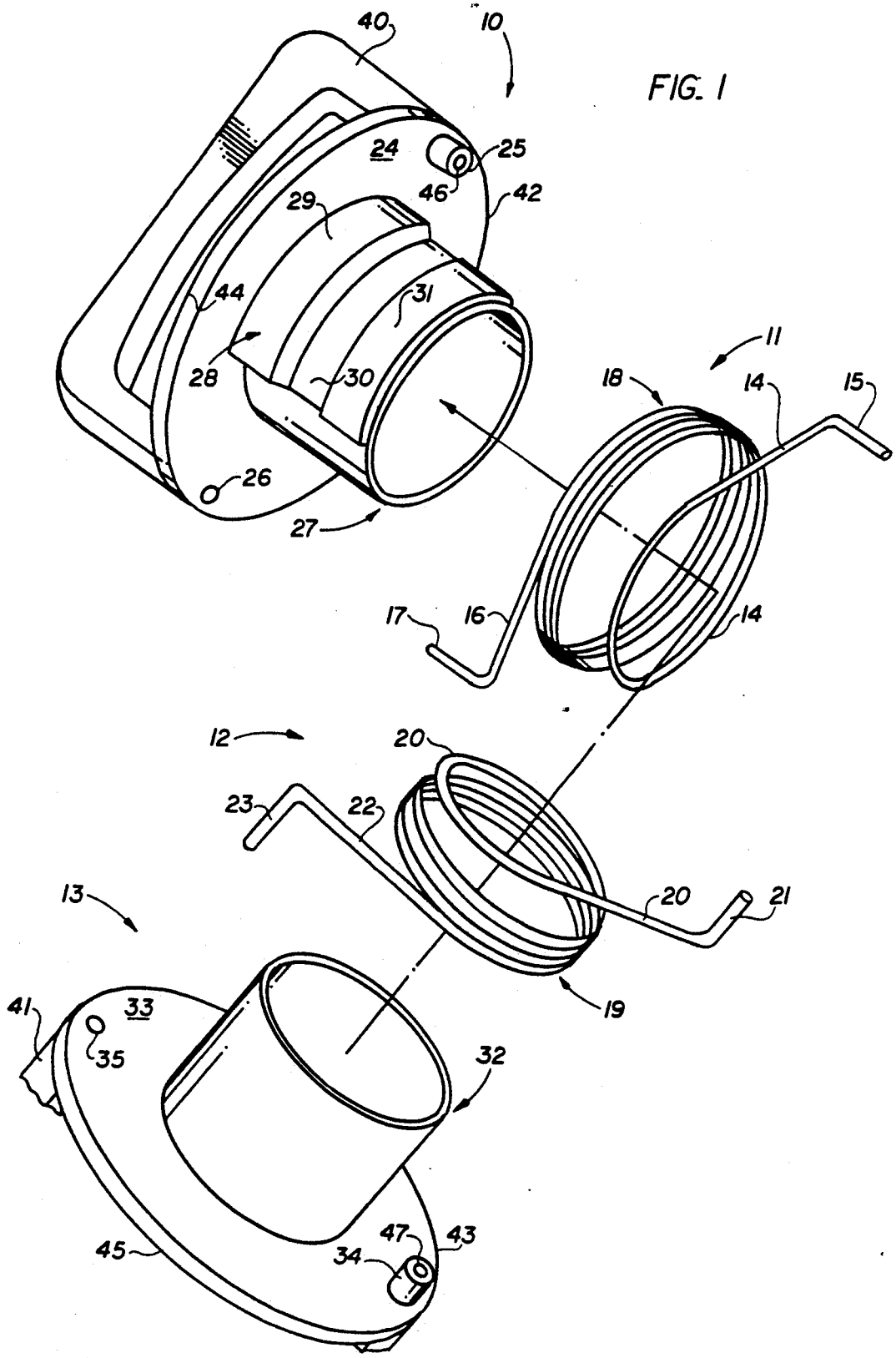
FIG. 1 is an exploded perspective view illustrating exercise apparatus constructed in accordance with the principles of the invention.

Briefly, in accordance with my invention, I provide improved wrist exercise apparatus a pair of handle units. Each handle unit includes a base having an outer side and inner side; a handle member extending outwardly from the outer side; and a pair of spaced apart recesses formed in the inner side. At least one stem element is attached to at least one of the inner side of the handle units. The stem element includes an arcuate outer surface and has a selected diameter. A pair of spring units are operatively attached at each of the opposite end to one of the inner sides and circumscribe the stem element. Each of the spring units includes a coiled helical spring element circumscribing a central axis and having a greater than the diameter of the stem element, and a pair of free ends outwardly tangentially extending from the spring element and each adapted to be received in one of the recesses in a different one of the handle units such that a first portion of the coiled helical spring element is biased against the stem element and a second portion of the coiled helical spring element is spaced apart from the stem element. The diameter of one of the spring elements is greater than the diameter of the other of the spring elements. The spring elements are spaced apart on and circumscribe the stem element. One of the free ends of one of the spring units can cross over one of the free ends of the other of the spring units at a point spaced apart from and intermediate the inner sides of the handle units.

DESCRIPTION OF THE PREFERRED EMBODIMENT(S)

Turning now to the drawings, which depict the presently preferred embodiments of the invention for the purpose of illustrating the practice thereof and in which like reference characters refer to corresponding elements throughout the several views, the exercise apparatus include a pair of handle units 10, 13. The first handle unit includes a circular base 42 and a handle member 40 extending outwardly from the outer side 44 of base 42. Base 42 includes inner side 24. Inner side 24 includes outwardly extending nub 25. The second handle unit includes a circular base 43 and a handle member 41 extending outwardly from the outer side 45 of base 43. Base 43 includes inner side 33. Inner side 33 includes outwardly extending nub 34. Recesses or apertures 26, 46 are formed in side 24. Recesses 35, 47 are formed in side 33. Cylindrical stem element 32 attached to side 33 is slidably received by cylindrical stem element 27 attached to inner side 24. Sleeve member 28 is attached to stem element 27. Sleeve member 28 includes interconnected arcuate members 29, 30, and 31. The width, indicated by arrows W, of member 29 is greater than the width, indicated by arrows Y, of member 31. The width, indicated by arrows X, of member 30 is less than the width of member 31. Member 28 is preferably fabricated from rubber or from some other sound-damping elastic material. If member 28 is fabricated from hard plastic, the magnitude of sound generated by a spring contacting member 28 ordinarily is greater than if the spring contacts a softer, elastic material. Member 28 presently only extends partially around stem element 27 because it is only important that member 28 cover the portion of element 27 against which the elements 18 and 19 are biased. If desired, member 28 can extend completely around stem element 27 as long as there is sufficient space between member 28 and springs 11, 12 to permit contraction and expansion of springs 11, 12 when handle units 10, 13 are rotated in opposite directions with respect to one another.

Spring unit 11 includes a coiled helical spring element 18 which circumscribes and is at all points generally equidistant from a centerline or axis. The diameter of element 18 is greater than the outer diameter of stem element 27 and is greater than the distance obtained by adding the width of member 29 to the outer diameter of hollow element 27. Free ends 14 and 16 outwardly tangentially extend from spring element 18. Free end 16 includes a distal end 17 adapted to be received in recess 26. Free end 14 includes a distal end 15 adapted to be received in recess 47. When ends 17 and 15 are inserted in recesses 26 and 47, ends 14 and 16 are squeezed together such that the angle F (FIG. 3}between ends 14 and 16 is reduced and element 18 is pressed or biased against member 29 in the direction of arrow C in FIG. 4. The angle F in FIG. 4 is less than the angle F between ends 14 and 16 when spring unit 11 is at rest and not tensioned. Spring unit 11 is illustrated at rest and not tensioned in FIG. 1. When spring unit 11 is at rest, angle F is less than 180 degrees.

Spring unit 12 includes a coiled helical spring element 19 which circumscribes and is at all points generally equidistant from a centerline or axis. The diameter of element 19 is less than the diameter of element 18, is greater than the outer diameter of stem element 27 and is greater than the distance obtained by adding the width of member 31 to the outer diameter of hollow element 27. Free ends 20 and 22 outwardly tangentially extend from spring element 19. Free end 20 includes a distal end 21 adapted to be received in recess 46. Free end 22 includes a distal end 23 adapted to be received in recess 35. When ends 21 and 23 are inserted in recesses 35 and 46, ends 20 and 22 are squeezed together such that the angle between ends 20 and 22 is reduced and element 19 is pressed or biased against member 31 in the direction of arrow C in FIG. 4. Spring unit 12 is illustrated at rest and not tensioned in FIG. 1. When spring unit 12 is at rest, the angle between ends 20 and 22 is less than 180 degrees. In the presently preferred embodiment of the invention, the angle between ends 20 and 22 is approximately equal to the angle F between ends 14 and 16 of spring unit 12.

Figure 2:
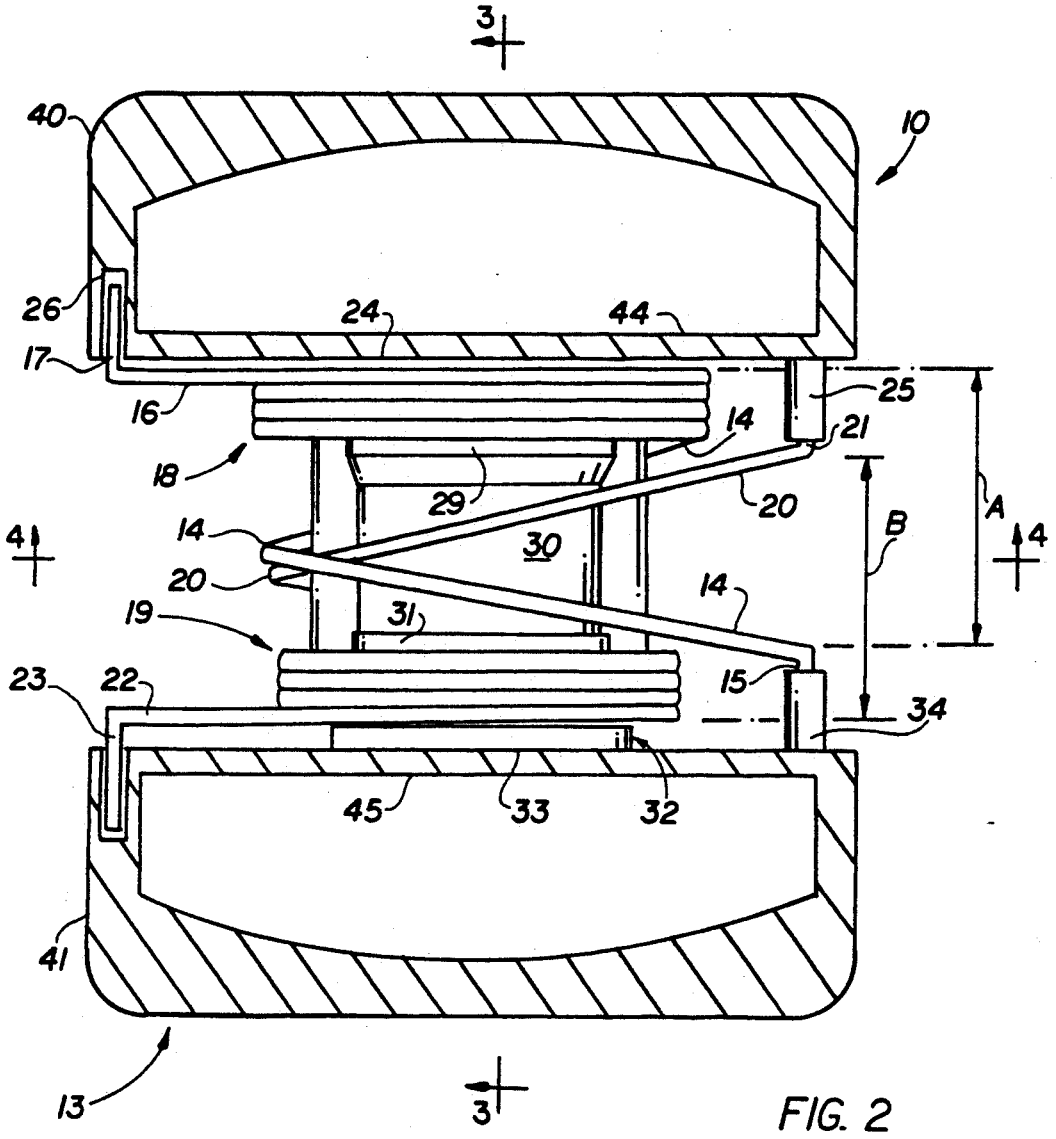
FIG. 2 is a side partial section view of the apparatus of FIG. 1 assembled and ready for use.
Figure 3:
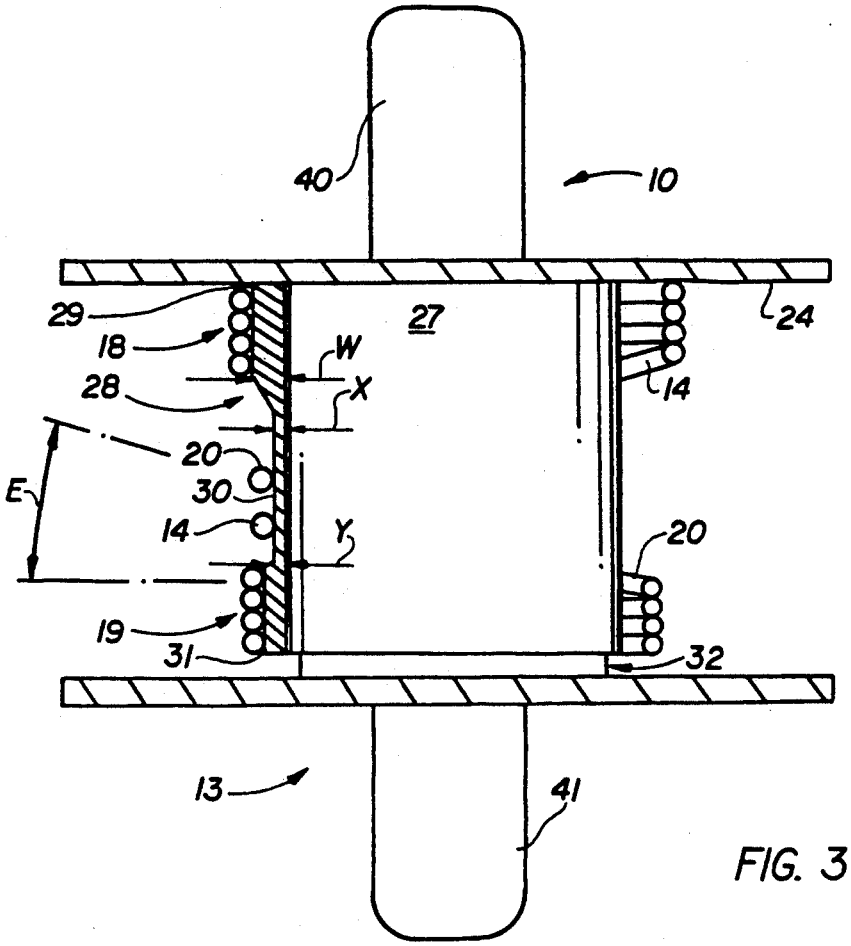
FIG. 3 is a section view of the apparatus of FIG. 2 illustrating further construction details thereof and taken along section line 3—3 thereof; and, FIG. 4 is a partial section view of the apparatus of FIG. 3 taken along section line 4—4 thereof.
Figure 4:
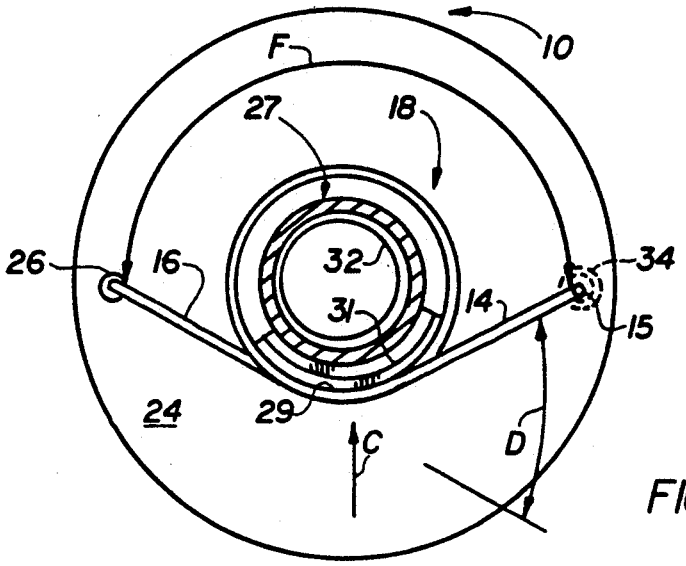

As can be seen in FIGS. 2 and 3, when the exercise device of the invention is assembled, free ends 14 and 20 cross over one another at a point intermediate members 29 and 31, intermediate inner side 24 and 33, and adjacent member 30. The diameter of element 19 is less than the diameter of element 18 to facilitate the cross over of ends 14 and 20. The cross over of ends 14 and 20 is important in the practice of the invention because it facilitates maintaining a space between elements 18 and 19. Maintaining a space between elements 18 and 19 is desirable because it prevents elements from intertwining or interlocking.

In the presently preferred embodiment of the invention, when spring units 11 and 12 are at rest, the angle D between ends 14 and 16 of unit 11 is approximately equal to the comparable angle between ends 20 and 22 of spring unit 12. Angle D is presently in the range of 20 to 30 degrees and is preferably about 25 degrees.

Maintenance of a space between spring elements 18 and 19 and the crossover of ends 14 and 20 is facilitated by several structural features of the embodiment of the invention illustrated in FIGS. 1 to 4. First, the distance indicated by arrows A for the larger diameter spring unit 11 is about 1.30 inches, while the comparable distance indicated by arrows B for the smaller diameter spring unit 12 is about 1.40 inches. This difference between distances A and B facilitates the cross over of free ends 14 and 15. Second, the angle indicated by arrows E in FIG. 3 between the end 20 and spring element 19 of spring unit 12 is presently in the range of twenty-five to forty degrees, preferably thirty to thirty five degrees. This angle E represents a comparatively steep, rapid rise of end 20 from element 19 and facilitates both the crossover of end 14 and 20 and the maintenance of a space intermediate spring coils or elements 18 and 19. Third, nubs 25 and 34, which are of equal shape and dimension, extend upwardly from inner sides 24 and 33, respectively, and promote maintenance of the spacing between coil elements 18 and 19.

As shown in FIGS. 3 and 4, a first portion of coil 18 (the left hand portion of coil 18 in FIG. 3) contacts member 29. A second portion of coil 18 (the right hand portion of coil 18 in FIG. 3) is opposite the first portion of coil 18 and is spaced apart from stem 27. The spacing between the second portion of coil 18 and stem 27 is important because it permits the diameter or width of coil 18 to lessen when coil 18 is contracted due to the rotation of the handle units in opposite directions. If, instead, the inner diameter of coil 18 was about equal to the outer diameter of stem 27, then the diameter of coil 18 could not contract during contraction the coil 18, coil 18 would contact and frictionally engage stem 27, and rotation of the handle units would be prevented. Similarly, as shown in FIGS. 3 and 4, a first portion of coil 19 (the left hand portion of coil 19 in FIG. 3) contacts member 31. A second portion of coil 19 (the right hand portion of coil 19 in FIG. 3) is opposite the first portion of coil 19 and is spaced apart from stem 27. The spacing between the second portion of coil 19 and stem 27 is important because it permits the diameter of coil 19 to lessen when coil 19 is contracted due to the rotation of the handle units in opposite directions.

In use, handle 40 and 41 are grasping and the handle units are rotated in opposite directions against the force of the spring units 11 and 12. When one of the handle units are rotated in a first direction relative to the other handle unit, element 18 is contracted and element 19 is expanded. When said one of the handle units is rotated in the other direction with respect to the other handle unit, the element 18 is expanded and element 19 is contracted. When spring elements 18 and 19 each, whether contracted or expanded, provide resistance to the rotation of the handle units is opposite directions. The expansion of one element during the expansion of the other element 18 or 19, facilitates the crossover of ends 14 and 20.

Having described my invention in such terms as to enable those skilled in the art to understand and practice it, and having identified the presently preferred embodiments thereof, I claim:

1. Wrist exercise apparatus including (a) a pair of handle units each including (i) a base having an outer side and inner side, (ii) a handle member extending outwardly from said outer side, (iii) a pair of spaced apart recesses formed in said inner side;

(b) at least one stem element attached to at least one of said inner sides of said handle units, said stem element including an arcuate outer surface and having a selected diameter;

(c) a sleeve element extending outwardly from said stem element and including (i) a first arcuate member having a selected width, and (ii) a second arcuate member spaced apart from said first arcuate member and having a selected width greater than the width of said first arcuate member;

(d) a pair of spring units operatively attached at each of their opposite ends to one of said inner sides and circumscribing said stem element, each of said pair of spring units comprising (i) a coiled helical spring element having a diameter greater than sum of the diameter of said stem element and the width of at least one of said first and second arcuate members, (ii) a pair of free ends outwardly tangentially extending from said spring element and each adapted to be received in one of said recesses in a different one of said handle units such that a portion of said coiled helical spring element is biased against one of said first and second arcuate members and a second portion of said coiled helical spring element is spaced apart from said stem element;

the diameter of one of said spring elements being greater than the diameter of the other of said spring elements, said spring element with the greater diameter being biased against said second arcuate member, said spring element with the lesser diameter being biased against said first arcuate member; and, said spring elements being spaced apart on and circumscribing said stem element.

2. The apparatus of claim 1 wherein one of said free ends of one of said spring units crosses over one of aid free ends of the other of said spring units at a point spaced apart from and intermediate said inner sides of said handle units and intermediate said first and second arcuate members.

3. The apparatus of claim 1 wherein said sleeve element includes a third arcuate member intermediate said first and second arcuate members and having a width less than the width of each of said first and second arcuate members.

4. The apparatus of claim 3 wherein said third arcuate member is elastic and dampens noise produced when once of said free ends contacts said third arcuate member.

5. Wrist exercise apparatus including (a) a pair of handle units each including (i) a base having an outer side and inner side, (ii) a handle member extending outwardly from said inner side, (iii) a pair of spaced apart recesses formed in said inner side;

(b) at least one stem element attached to at least one of said inner sides of said handle units, said stem element including an arcuate outer surface and having a selected diameter;

(c) a sleeve element extending outwardly from said stem element and including a first arcuate member having a selected width, and (d) a pair of spring units operatively attached at each of their opposite ends to one of said inner sides and circumscribing said stem element, each of said pair of spring units comprising (i) a coiled helical spring element having a diameter greater than sum of the diameter of said stem element and the width of said first arcuate member, and (ii) a pair of free ends outwardly tangentially extending from said spring element and each adapted to be received in one of said recesses in a different one of said handle units such that a portion of said coiled helical spring element is biased against said stem element and a second portion of said coiled helical spring element is spaced apart from said stem element;

the diameter of one of said spring elements being greater than the diameter of the other of said spring elements;

said spring elements being spaced apart on and circumscribing said stem element;

one of said free ends of one of said spring units crossing over one of said free ends of the other of said spring units at a point spaced apart from and intermediate said inner sides of said handle units and adjacent said first arcuate member.

6. The apparatus of claim 5 wherein said first arcuate member is elastic and dampens noise produced when one of said crossing free ends contacts said third arcuate member.

* * * * *